United States Patent [19]

Bullock et al.

[11] Patent Number: 5,037,255

[45] Date of Patent: Aug. 6, 1991

[54] WHEEL CHOCK FOR A MOTOR VEHICLE CONTAINER

[75] Inventors: Robert L. Bullock, Antioch; Armand P. Taillon, Lake Bluff, both of Ill.

[73] Assignee: Standard Car Truck Company, Park Ridge, Ill.

[21] Appl. No.: 485,381

[22] Filed: Feb. 26, 1990

[51] Int. Cl.[5] ..... B60P 3/075

[52] U.S. Cl. ..... 410/30; 410/9; 410/19

[58] Field of Search ..... 410/3, 4, 7, 8, 9, 19, 410/26, 30, 47, 49; 188/36; 105/378

[56] References Cited

U.S. PATENT DOCUMENTS

| | | | |
|---|---|---|---|
| 1,778,162 | 10/1930 | Mills et al. . | |
| 4,343,401 | 8/1982 | Paulyson et al. . | |
| 4,674,929 | 6/1987 | Blunden | 410/30 |
| 4,679,974 | 7/1987 | Blunden | 410/30 |
| 4,836,726 | 6/1989 | Robertson et al. | 410/9 |
| 4,838,743 | 6/1989 | Blunden et al. | 410/9 |
| 4,875,813 | 10/1989 | Moyer et al. . | |
| 4,876,968 | 10/1989 | Lindauer et al. . | |

*Primary Examiner*—David A. Bucci
*Assistant Examiner*—Craig Slavin
*Attorney, Agent, or Firm*—Lloyd L. Zickert

[57] ABSTRACT

A wheel chock for a motor vehicle container made of composite material which is adapted to be selectively connected to a pair of rails fastened to the container floor, and which is made of a flexible copolymer material capable of withstanding the loads incurred by vehicles restrained by the chocks, and which is constructed to be easily connected to and disconnected from the rails and be supported above the container floor to prevent damage to the floor.

26 Claims, 7 Drawing Sheets

WHEEL CHOCK FOR A MOTOR VEHICLE CONTAINER

DESCRIPTION

This invention relates in general to a wheel chock for use in containers transportable on railroads for constraining the movement of vehicles within the container, and more particularly to a wheel chock generally made of a flexible plastic material to absorb the loads incurred during movement of the containers, and still more particularly to a wheel chock that may be easily mounted onto and dismounted from a pair of rails fastened to the floor of the container, and more particularly to a wheel chock that is constructed to be supported above the container floor so as to prevent damage to the floor.

BACKGROUND OF THE INVENTION

Wheel chocks for constraining the movement of motor vehicles such as automobiles, sport trucks or other wheeled vehicles, transported on railroad cars have been well known. It has also been known to provide wheel chocks in wheeled shipping containers for railroads, as disclosed in U.S. Pat. No. 4,343,401.

It has also been known to construct wheel chocks from flexible plastic material, as disclosed in U.S. Pat. No. 4,875,813.

SUMMARY OF THE INVENTION

The wheel chock of the present invention is constructed to be used in a box-shaped composite container to constrain movement of motor vehicles that are being transported by intermodal service where the container may be selectively placed on a railroad car for long-distance transportation, a wheeled truck for short hauling, or on a sea-going cargo vessel, it being important to have the container made of light-weight materials to save shipping costs. With the advent of composite materials, such a light-weight container is possible for use in transporting motor vehicles in that the vehicles are completely enclosed from the weather and also protected from vandals.

The wheel chock of the present invention is constructed to be used in such containers where the floor and walls are of cellular form much like a corrugated cardboard container. It is important that the wheel chock not contact the floor of the container when subjected to loads from the wheels of the automobiles in order to prevent damage to the floor. It is also important that the wheel chock be constructed to minimize the possibility of damage to the vehicle when contacting the vehicle when the chock is mounted and dismounted on rails in the container. By making the wheel chock of the invention of a plastic material, contact between the chock and the vehicle minimizes any possible damage to the vehicle.

The wheel chock of the invention includes a body that is molded of plastic with upper sloping surfaces for contact with a vehicle wheel and with means at both ends for engaging with a pair of spaced rails. One or more boss/catches are molded integrally at one end of the chock to engage in a notched opening of a rail and metal pins are mounted at the other end of the chock for engagement with holes of the opposing rail. A catch or latch is molded of the same or similar material as the body of the chock and mounted at the end of the chock where the pins are located to coact with the rail in selectively locking the chock to the rails. Engagement and disengagement between the chock and the rails is accomplished by movement of the chock transverse the longitudinal axis of the rails.

The chock is constructed to coact with the rails so as to be supported above the container floor. Additionally, the chock is constructed to have a stiffness to generally vertical loads and a flexibility to generally longitudinal loads. The vertical stiffness prevents contact between the chock and the container floor to protect the integrity of the floor, and the longitudinal flexibility absorbs loads caused by the shifting of the vehicle on the container floor. Additionally, the chock is constructed to provide an interface contact with the rails so as to create a significant static frictional force upon being subjected to a vertical load.

It is therefore an object of the present invention to provide a new and improved wheel chock for chocking motor vehicles in intermodal containers transported by railroad, highway or water.

It is a further object of the present invention to provide a wheel chock that is especially suitable for use in a compositely constructed container wherein the wheel chock is supported above the container floor and otherwise constructed in order to prevent damage of the container floor.

A still further object of the present invention is in the provision of a wheel chock that is essentially made of flexible plastic material for use in restraining the movement of motor vehicles transported in containers and also for absorbing loads produced during handling and transport of the containers.

A still further object of the present invention is to provide a unique wheel chock compatible with an intermodal container made of composite material and which is supported on and selectively fastened to a pair of spaced rails for chocking the front and back sides of a wheel of a motor vehicle and which may be easily mounted on the rails or dismounted from the rails during the constraining and loading and unloading of vehicles in the container.

Other objects, features and advantages of the invention will be apparent from the following detailed disclosure, taken in conjunction with the accompanying sheets of drawings, wherein like reference numerals refer to like parts.

DESCRIPTION OF THE INVENTION

The wheel chock of the present invention is constructed to be compatible with the newly developed S.M.A.R.T. (Secured Modular Automobile Rail Transport) intermodal container made of composite material and is especially useful for transporting motor vehicles. Although the chock of the invention is especially useful for the S.M.A.R.T. vehicle container, it will be appreciated it could be used with other containers or wherever there would be a need to chock the wheels of a wheeled vehicle and to mount the chock above the floor. The use of the words "motor vehicle" herein would include automobiles, sport trucks, and other wheeled vehicles.

The intermodal container is one that would be transportable by railroad, highway or water, it being understood that generally when transported on a railroad car or a seagoing cargo vessel, such would normally involve a long-haul situation, and when generally transported on a wheeled truck on a highway, such would normally involve a short-haul situation. Thus, the container for which the chock of the invention is especially used is one made of composite material to minimize weight and shipping costs, and which is generally box-shaped with doors at either or both ends for loading and unloading of vehicles from either or both ends.

The chock of the invention includes a body molded of a plastic material having good impact strength over a wide range of temperatures encountered by railroads. This material is resilient and has good memory characteristics. Suitable plastics are copolymers, such as Xenoy DX 5720 marketed by General Electric Company and Nyrim 1000 marketed by DSM RIM Nylon Inc. The chock of the invention is constructed to coact with two spaced apart aluminum chockrails fastened to the container floor and to interact with a wheel of a vehicle to prevent relative longitudinal movement of the vehicle. A pair of identical chocks, one in front and one in back of one or more wheels, is used to restrain the vehicle against movement and without the need of wheel straps or harnesses or any other device to anchor the vehicle to the container. The wheel chock distributes all loads generated by the vehicle wheel through the chockrails.

Figure 1:
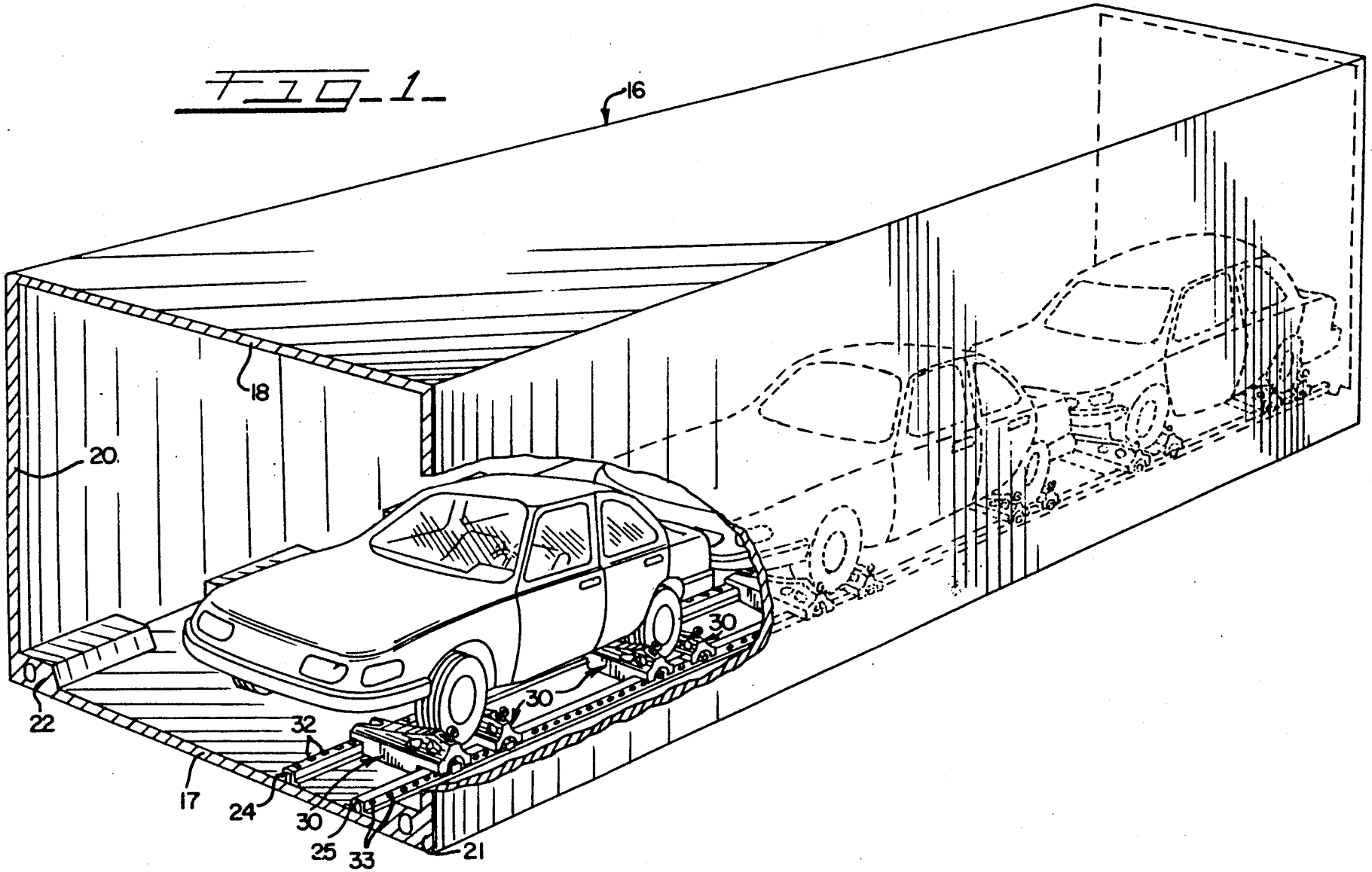
FIG. 1 is a fragmentary and partly schematic perspective view of an intermodal container for wheeled vehicles and showing generally the use of the wheel chock of the present invention.

Referring now to the drawings, and particularly to FIG. 1, an intermodal container, generally designated by the numeral 16, includes a floor 17, a top wall 18, and opposed side walls 19 and 20. While not shown, it will be understood that suitable doors will be provided at each end of the container to permit loading and unloading of vehicles from either end. It will be appreciated that only one end may include a door, if so desired, and in that case loading and unloading would be only at that end. The floor, top wall and side walls are constructed of a composite material which would include suitable inner and outer sheeting separated by a cellular-like structure that would provide proper support to the sheeting elements. The container does not form a part of the invention but is noted because the chock of the invention is constructed to protect the floor of such a composite container against damage.

The outer longitudinal sides of the floor are reinforced with the side walls at 21 and 22, thereby providing a shoulder extending inwardly from the side walls that also extend above the floor. The reinforcing shoulder may be intermittently formed on the side of the container away from the chock rails to further reduce container weight. This is illustrated in FIG. 1.

Chock-rails 24 and 25 of inverted U shape are suitably fastened to the floor of the container. These rails extend parallel to each other and, as shown in FIG. 1, are arranged at one side of the container s that wheels at one side of the vehicle will be received between the rails. The rails extend longitudinally of the container, and while only one pair of rails is illustrated at one side of the container, it will be appreciated that another pair may be located at the other side of the container. Normally, the car will be chocked only at one side and preferably the driver's side, whereby upon driving the vehicle into the container the driver would exit the car and mount a pair of chocks in place for one or more wheels. As illustrated, the pair of chocks according to the invention, and generally indicated by the numeral 30, is shown for restraining the front left and rear wheels of each vehicle by being releasably secured to the rails 24 and 25.

The inner rail 24 includes a plurality of equally spaced apart notched openings 32, while the outer rail 25 includes a plurality of spaced apart holes 33. As seen particularly in FIGS. 2 and 3, each chock-rail includes a top generally horizontally extending wall 35, generally vertically extending side walls 36 and 37 and attaching flanges 38 and 39. Any suitable fastening means may be utilized to coact with the attaching flanges 38 and 39 to fasten the chock-rails to the container floor 17. The notched openings 32 are formed in a part of the top wall 35 and a part of the side wall 36 of the inside rail 24 so that the notched openings are on the edge of the chock-rail 24 opposite from the chock-rail 25. The notched openings are essentially rectangular in shape when viewed from the top of the rail and rectangular in shape when viewed from the side of the rail and define in the top of the rail a lip 40 which coacts with one end of the chock, as will be further described below. Further, the vertical side edges of the notched openings will coact with a part of the chock as described below.

The outside rail 25 includes a plurality of spaced holes 33 formed in both of the side walls, although it would only be necessary to have holes formed on the side wall 36 which is the one closest to the chock-rail 24. As will be further discussed below, each notched opening of rail 24 aligns with a hole in rail 25. With respect to mounting a pair of chock-rails at the other side of the container, it will be appreciated that the inside rail will have the notched openings, while the outside rail will have the holes as the placement of the chock is more conveniently handled from the area near the outside rail at the side of the vehicle being chocked.

Figure 8:
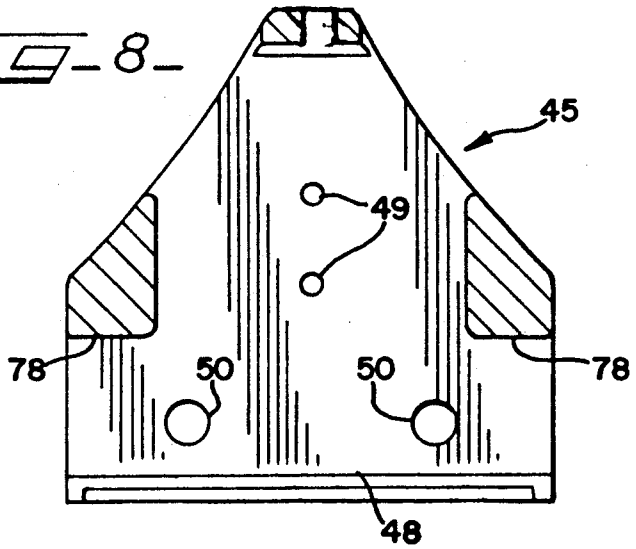
FIG. 8 is a vertical sectional view taken substantially along line 8—8 of FIG. 4 with the pins and catch removed.

The chock is made up of four parts which include a main body 45, a catch or latch 46, and a pair of pins 47. The main body 45 is molded of a copolymer material such as above identified. Similarly, the catch 46 is molded of the same copolymer material or one that will allow the catch to function in a suitable fashion. The pins 47 are made of metal. Assembly of the parts merely involves mounting the catch on the body of the chock and similarly mounting the pins on the body of the chock. In this embodiment, the pins are press-fit into predrilled holes. Following the molding of the body 45, four holes are drilled in the body and particularly in a vertical wall 48, as seen in FIG. 8. The holes include vertically aligned and centrally disposed holes 49 for mounting the catch and horizontally aligned holes 50 at the lower end of the wall 48 for mounting of the pins 47. Another form of a pin is shown in the embodiment of FIGS. 15 to 18 and described below.

Figure 2:
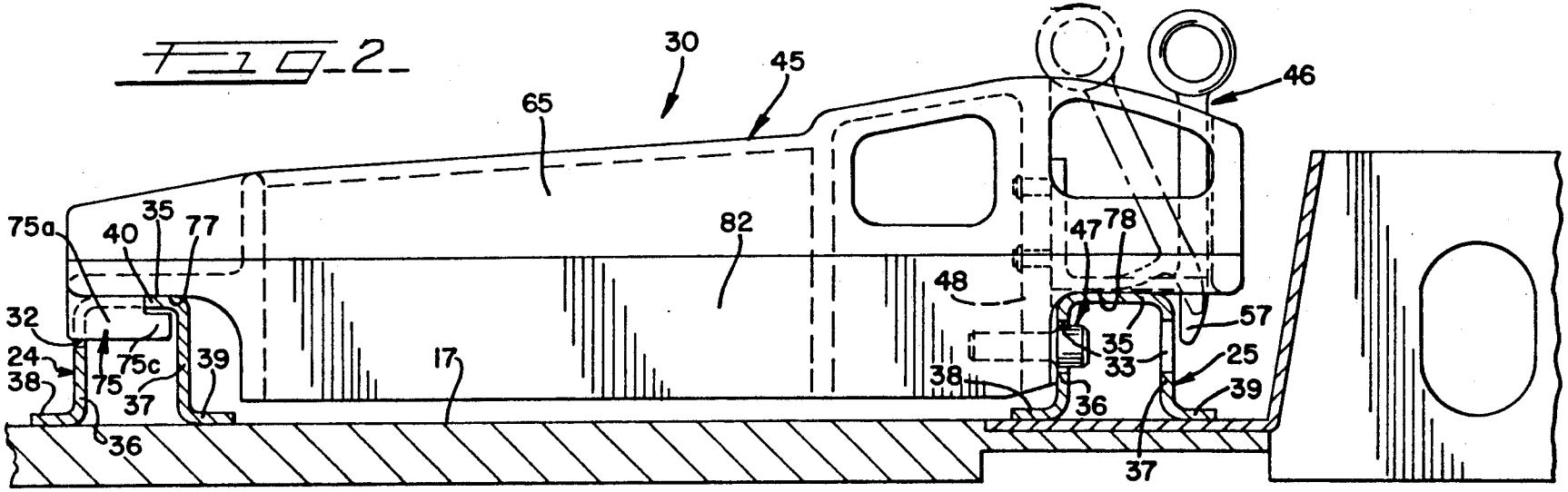
FIG. 2 is a fragmentary cross section of the floor of a composite container having a pair of rails mounted on the floor and a wheel chock of the present invention mounted on the rails, wherein the wheel chock is shown in side elevation with some parts in dotted lines for clarity and illustrating the catch or latch in latched position in solid and in unlatched position in phantom.
Figure 3:
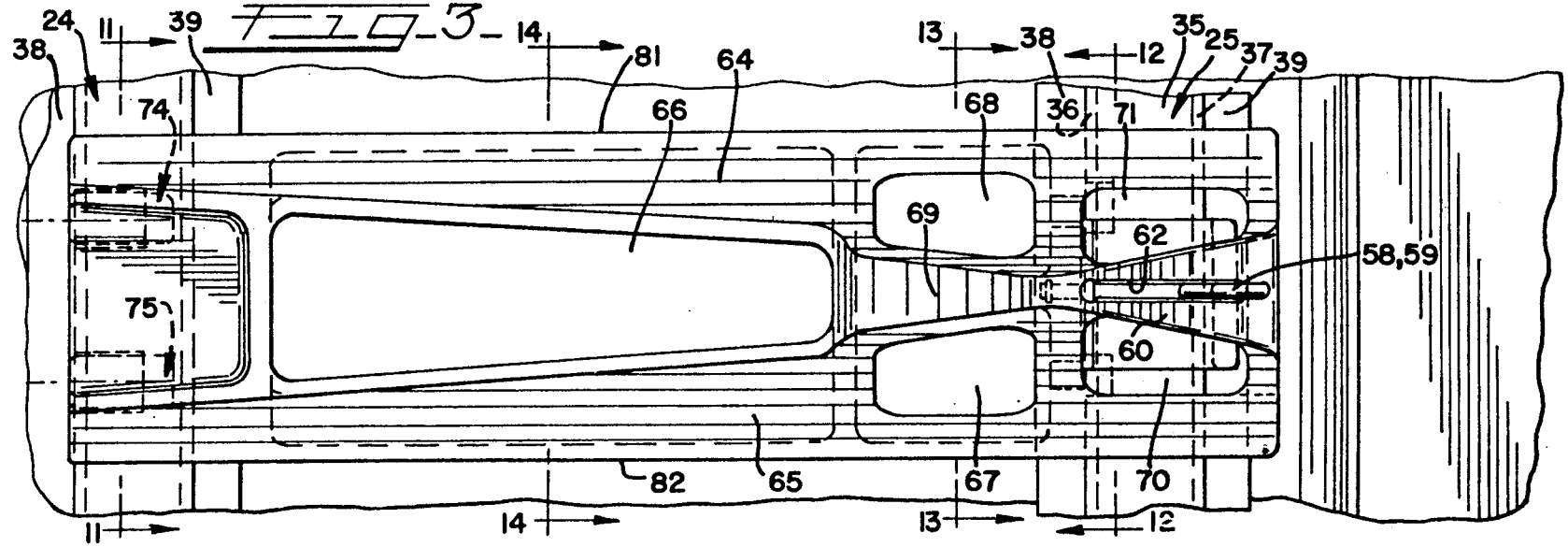
FIG. 3 is a top plan view of the chock shown in FIG. 2 and showing some parts in dotted lines.

The catch or latch 46 includes a vertically extending base wall 53 having projecting therefrom at one side mounting studs 54 with an annular enlargement 55 near their ends. Extending horizontally from the bottom edge of the vertically extending base wall 53 is a support wall 56. At the free end of the support wall, a downwardly extending projection wall 57 extends in a substantially vertical direction and which functions as a rail latching member. Extending vertically upwardly from the horizontal wall 56 is a handle 58 terminating in a ring 59. Assembly of the latch 46 to the body 45 requires forcing the studs 54 into the predrilled holes 49 until the enlargement 55 passes through the holes to lock against the other side of the wall, as seen in FIG. 2. The upper part of the handle 58 and ring 59 project through an elongated slot 62 in the upper wall 60 of the chock body 45 so as to provide access to a person handling the dismounting of the chock from the rails. Described below is another form of latch and slot shown in the embodiment of FIGS. 17 to 23.

The chock body 45 includes at the upper side outer sloping walls 64 and 65 symmetrically formed at each upper side of the body for engagement with a vertical wheel at the front or back side of the wheel depending upon the position of the chock to the wheel. The upper edges of the walls terminate in spaced relation from each other to define an opening 66 that extends intermediate the ends of the body.

It will be appreciated that the opening 66 provided through the center of the chock not only reduces the total weight of the chock but also serves to provide more flexibility for the sloping walls 64 and 65 which will be subjected to forces from the automobile wheel. Further, openings 67 and 68 are provided in the chock body, as seen particularly in FIG. 3, and which are disposed closer to the catch end of the chock. These openings are provided to also facilitate the reduction of weight as well as to define therebetween a bar or rib 69 that can serve as a handle for manipulating the chock when mounting and dismounting on the chock-rails. Spaced from the openings 67 and 68 and at the catch end of the chock are further openings 70 and 71 in the area of the catch and on opposite sides of the catch handle 58, 59. These openings also reduce the overall weight of the chock as well as provide gripping areas for assisting in the mounting and dismounting of the chock on the chockrails. The openings 70 and 71 are likewise symmetrically arranged, as are the openings 67 and 68, and further function to some degree to enhance the load absorption characteristics of the chock.

Figure 6:
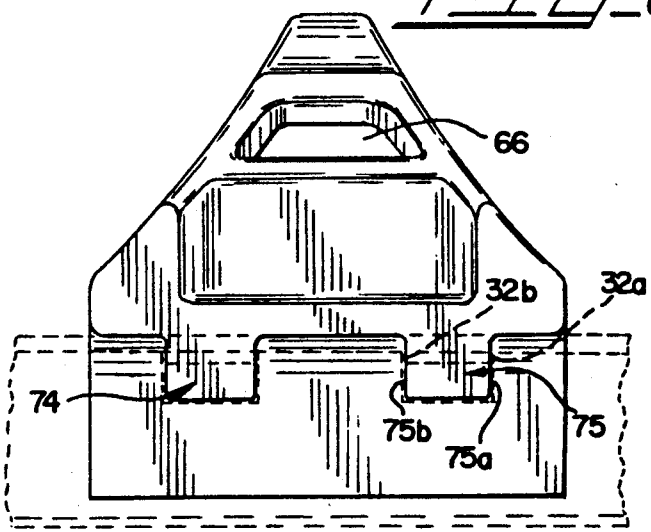
FIG. 6 is an end elevational view of the chock of FIG. 2 and showing the boss/catch end and showing a portion of the outside rail in phantom.
Figure 5:
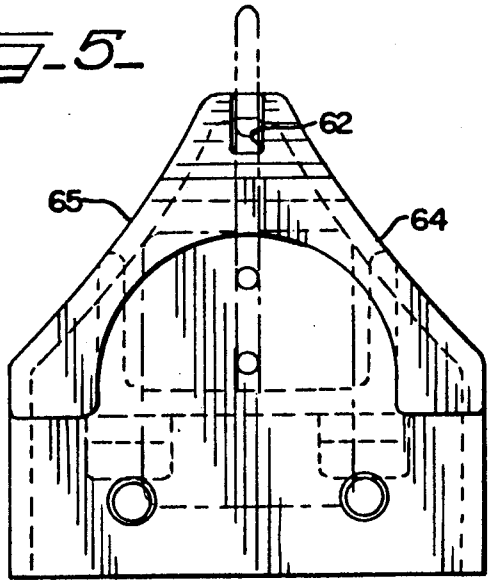
FIG. 5 is an end elevational view of the chock shown in FIG. 2 and particularly of the latch end of the chock.

The chock is mounted on the inside rail 25 and held in place against movement longitudinally of the rail and upwardly of the rail by a pair of spaced apart boss/catches 74 and 75 which are not only received in the notches 32 of the chock-rail 24 but also coact with the lip 40 to collectively resist movement longitudinally of the chock-rail and movement upwardly of the chock-rail. It will be appreciated that any number of boss/catches may be provided. Each boss/catch includes opposed generally parallel extending side walls **74*a*, 74*b* and 75*a*, 75*b* which function to bear against the opposed vertical faces of the notch 32 as identified to be 32*a* and 32*b* in FIG. 6. Further, each boss/catch is notched at the end closest to the catch end of the chock to define a slot and a projection 74*c* and 75*c* which coacts with the lip 40 to prevent movement of the chock upward from the chock-rail, as seen particularly in FIG. 2. The projection end of the boss/catch has rounded corners to facilitate easy engagement with the chock-rail notch and thus facilitates the entry of the boss/catch into the notched openings when mounting the chock on the chockrails. It will be appreciated that the relatively flat side walls of each boss/catch provides uniform load distribution over the cross sectional areas of the notched openings. The boss/catch end of the chock is essentially cut out or formed to allow compatible fitting with the chock-rail and includes a horizontally extending supporting face 77, as seen in FIG. 2**, which engages the upper surface of the top wall of the chock-rail to support the vertical downward forces exerted by the automobile wheel. Thus, the chock-rail interfaces react to the vertical forces generated by the wheel.

Similarly, at the catch end of the chock it is notched or formed to provide a compatible fit with the chock-rail 25 and includes generally horizontally extending support faces 78 which engage the upper surface of the top wall 35 of the outside rail in reaction to the vertical downward forces produced by the automobile wheel. Similarly, the chock-rail interfaces at this end of the chock react to the downward vertical forces. Preferably, the top surfaces of the chock-rails are somewhat roughened so as to assist in resisting longitudinal movement of the chock caused by horizontal forces from the automobile wheels by creating a significant static frictional force as developed by the vertical load on the chock by the automobile wheel. This is accomplished by virtue of the deformable nature of the flexible material of the chock body when it is in contact with the hard and roughened surface of the chock-rails. The chock-rails will be made of a suitable metal such as aluminum or steel.

Figure 4:
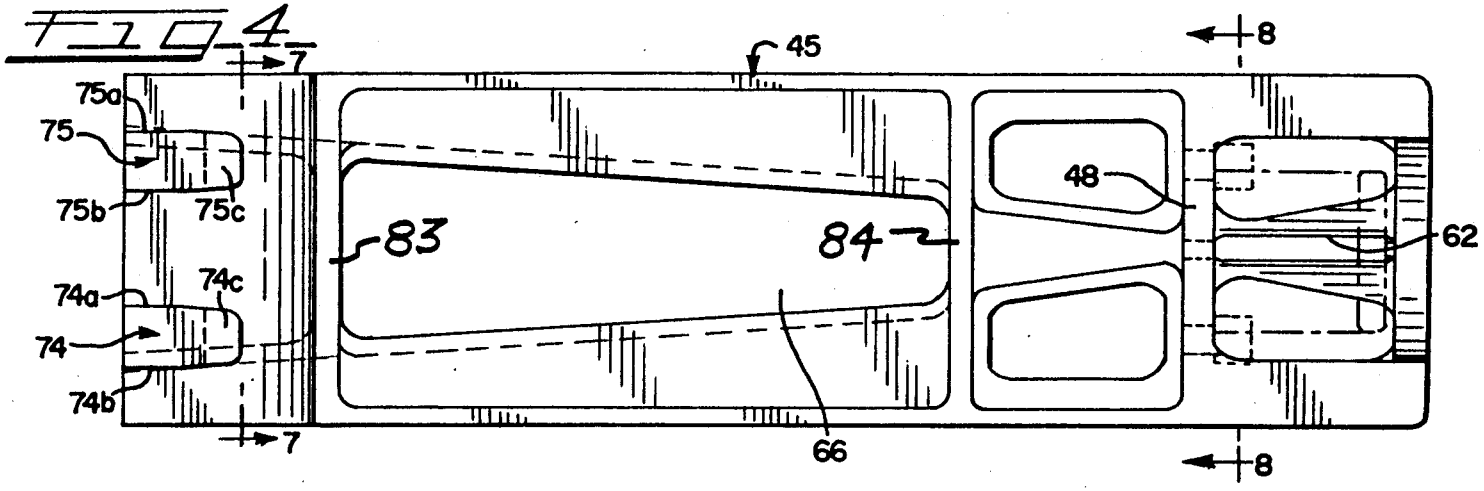
FIG. 4 is a bottom plan view of the chock shown in FIG. 2 and showing some parts in dotted lines.

The midsection of the chock includes downwardly extending vertical walls 81 and 82. These walls extend downwardly from the sloped wheel interface surfaces or walls 64 and 65 and make the chock relatively stiff in reaction to vertical loads and relatively flexible in reaction to longitudinal loads. The chock is constructed so that when it is mounted on the chock-rails it will be spaced above the floor 17, as can be seen particularly in FIG. 2, inasmuch as engagement with the floor could cause damage to the floor. Thus, the vertical stiffness of the chock as provided by the vertical side walls prevents contact between the chock and the container floor, while the longitudinal flexibility provides longitudinal load absorption. These characteristics are essential in preventing damage to the composite material of the container floor and in preventing damage to the automobile. Further, integrally molded transversely extending vertical ribs or walls 83 and 84, together with vertical wall 48, serve to reinforce the chock body, as seen in FIG. 4. Thus, the chock and the aluminum chockrails are designed to suspend the wheel chock in place above the container floor.

From the foregoing, it can be appreciated that the wheel chock embodiment of FIGS. 1 to 14 of the present invention may be easily and economically produced and assembled. The chock body and catch are molded of a flexible plastic material. The pins are preferably of metal but may be molded of plastic. Four drill holes made in the one panel of the chock for fastening the catch and pins to the chock body. The catch is made so that it can be easily secured to the chock body and is formed with a finger loop or ring for ease in movement to the disengaging position.

In operation, a driver would load a car onto the container, exit from the driver's side, and mount two chocks against the front and back sides of the front and back wheels received between the chock rails. The chocks may be easily mounted in place by aligning the boss/catches and the pins respectively with the notched openings on the inside rail and the holes on the outside rail and shifted transversely so that the boss/catches coact with the lip on the inside rail and the pins coact with the holes on the outside rail. It is not necessary to retract the catch as it will be forced upwardly by engagement of the projection 57 with the top of the outside chock-rail until it moves to the position where it can go to locked position, as shown in solid lines in FIG. 2. These steps then accomplish mounting of the chock in place on the rails. For dismounting it is first necessary to move the handle of the catch 46 to allow projection 57 to clear the outside rail when shifting the chock transversely of the rails to disengage the pins and boss/catches. Thus, it will be appreciated that the procedures for mounting and dismounting can be accomplished without the use of special tools and in a quick and easy manner.

A further embodiment of the invention is shown in FIGS. 15 to 23 which differs from the embodiment of FIGS. 2 to 14 in that the pins at the latch end of the chock are bolted to the chock body rather than being press-fit into holes, and further in that the latch is structured to be bolted to the chock body, and also to coact with a hook-shaped slot that allows locking of the latch in the position where the latch is locking the latch end of the chock body to the outside chock rail 25. Otherwise, this chock, which may be generally indicated by the numeral 30A, is constructed in the same fashion as chock 30 of the first embodiment.

The vertical wall 48 at the latch end of the chock body 45 is the same as the vertical wall 48 of the chock body in the first embodiment. Similarly, the holes drilled in this wall for fastening the pins to the wall and the latch to the wall are located in the same location as those in the first embodiment but would be sized to receive the necessary bolts used to fasten the pins and the latch to this wall. Thus, it will be appreciated that the chock body 45 is, for all practical purposes, of the identical construction in this embodiment as in the embodiment of FIGS. 2 to 14, although there is one additional difference and that is in the form of the slot formed in the top of the body at the latch end.

Figure 15:
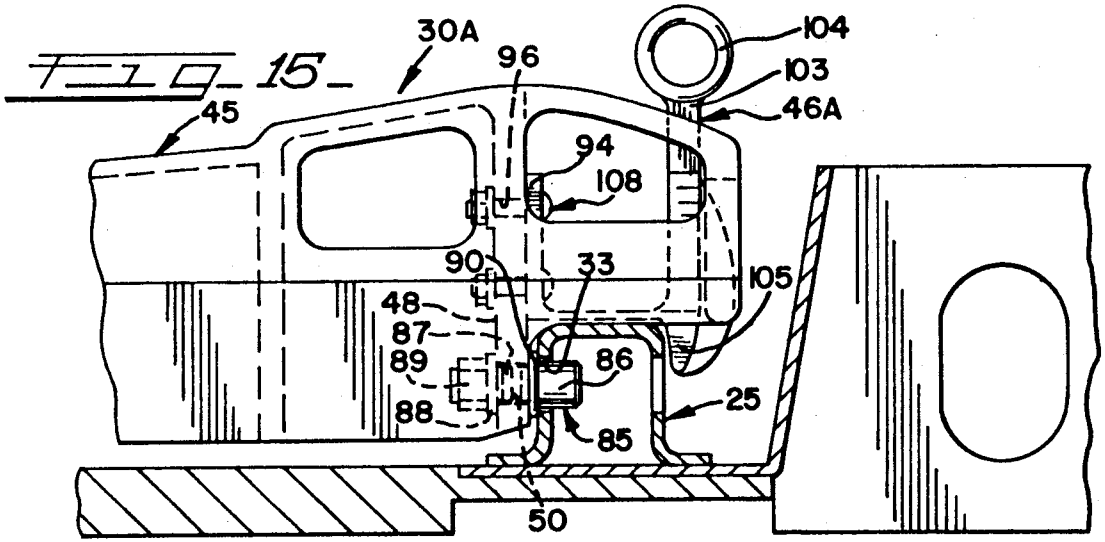
FIG. 15 is a fragmentary side elevation of a modified chock differing from the embodiment of FIG. 2 in that the pins are bolted to the chock body, and a modified latch is provided which is also bolted to the body to provide more reliable fastening of the pins and latch to the chock body.
Figure 16:
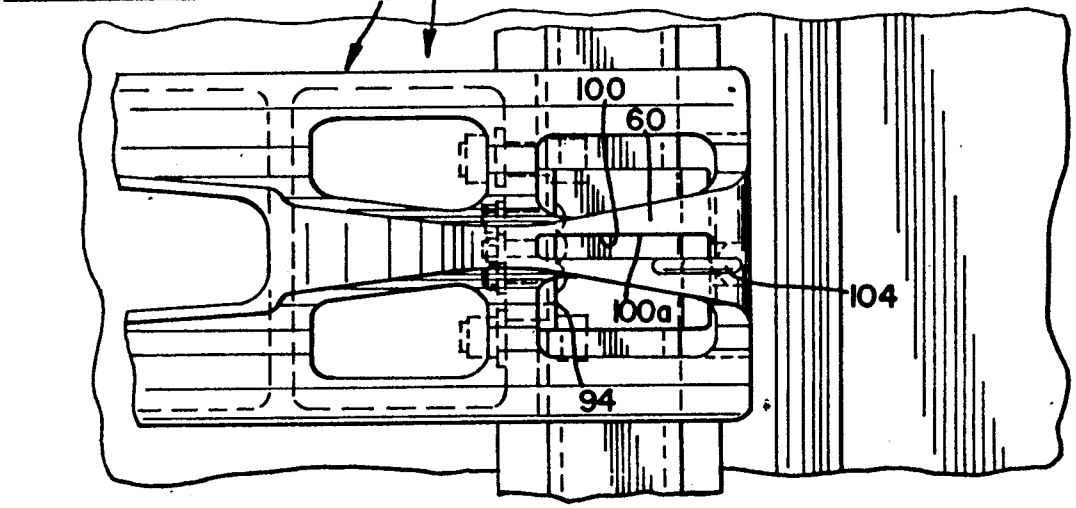
FIG. 16 is a top plan view of the modification of FIG. 15 showing the latch in locked position.

As above mentioned, the pins differ in that they are formed so that they can be bolted to the vertical wall 48, and the pins are generally designated by the numeral 85 and include a head 86 which is received and sized to be received in a hole 33 on the outside rail. Extending from the head and integral therewith is a threaded shank 87 which is of a length to extend through the wall and for receiving a washer 88 and a hexnut 89. Also, the head, if not large enough, would include at its base an integral washer 90 sized larger than the hole 50 in the vertical wall. Installation of the pins is a simple matter in that the pin with the shank is inserted into the hole 50 and fastened in place by the nut 89, as seen in FIGS. 15 and 16.

It will be appreciated that the bolted pins will be stronger than the pins that are press-fit into an opening and will be more secure in being fastened to the vertical wall 48.

Figures 18, 19, 20, 21, 22, 23:
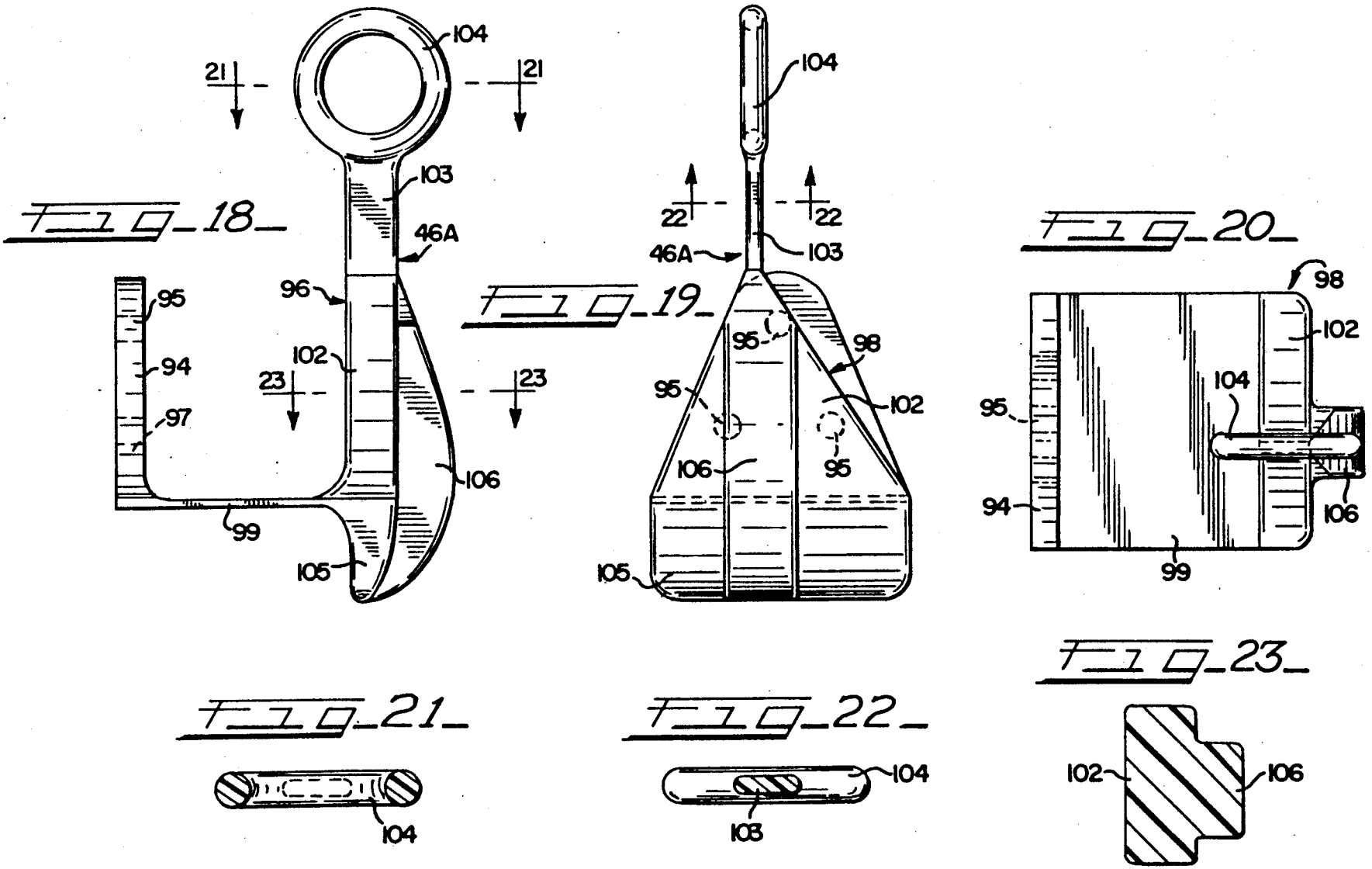
FIG. 18 is a side elevational view of the modified latch shown in FIGS. 15 to 17.
FIG. 19 is an end elevational view of the latch of FIG. 18.
FIG. 20 is a top plan view of the latch of FIG. 18.
FIG. 21 is a detailed horizontal sectional view taken through the latch handle substantially along line 21—21 of FIG. 20 and looking in the direction of the arrows.
FIG. 22 is a detailed sectional view taken through the latch handle substantially along line 22—22 of FIG. 19 and looking in the direction of the arrows.
FIG. 23 is a detailed sectional view taken through the latch substantially along FIGS. 23—23 of FIG. 18 and looking in the direction of the arrows.

The latch of this embodiment is generally designated by the numeral 46A and includes a vertically extending base wall 94 that is somewhat triangular in shape, as seen in FIG. 19, and provided with three triangularly disposed holes 95 aligning with three triangularly spaced holes 96 in the vertical attaching wall 48 of the main body.

Thus, the vertically extending base wall 94 is the attaching member for the latch 46A for attaching it to the chock body.

In parallel opposed position to the fastening flange 97 is a handle 98 and interconnected to the flange 97 by a relatively thin wall connecting web 99 which allows flexing between the handle 98 and the flange 97 during unlatching. The flange 97 would be securely fastened to the vertical wall 48 of the chock body to fasten the latch to the chock body.

Figure 10:
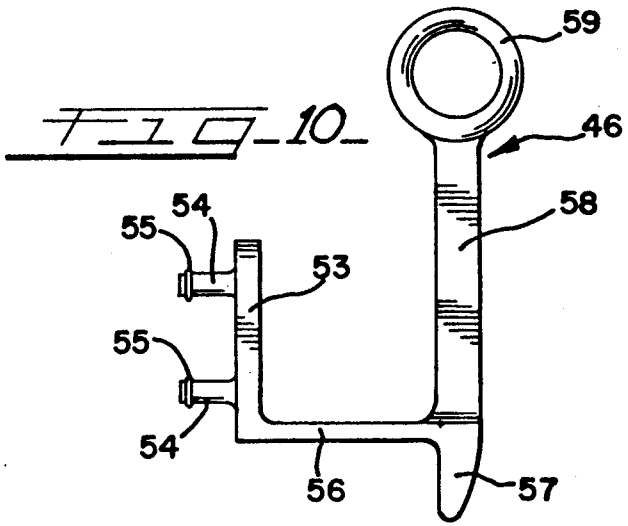
FIG. 10 is a side elevational view of the latch of FIG. 9.
Figure 7:
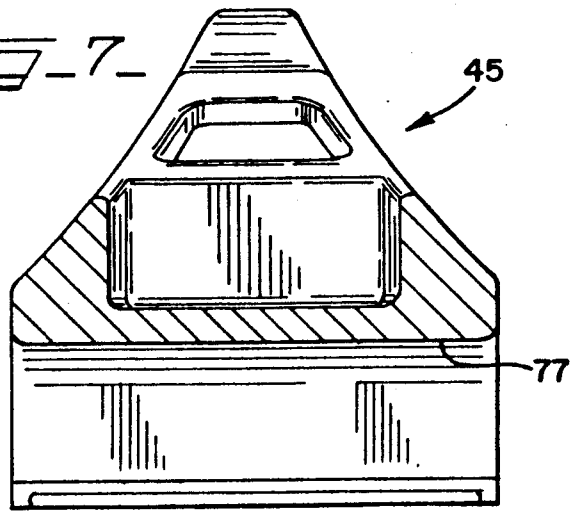
FIG. 7 is a vertical sectional view taken substantially along line 7—7 of FIG. 4.
Figure 9:
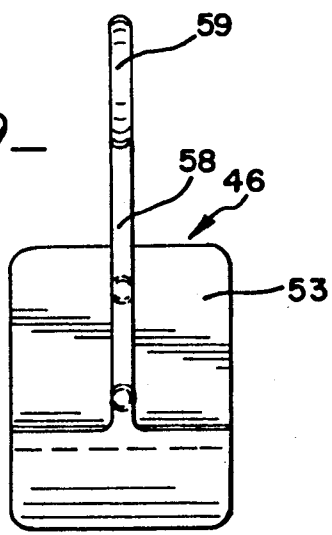
FIG. 9 is an end elevational view of the catch or latch prior to being mounted on the chock body.
Figure 11:
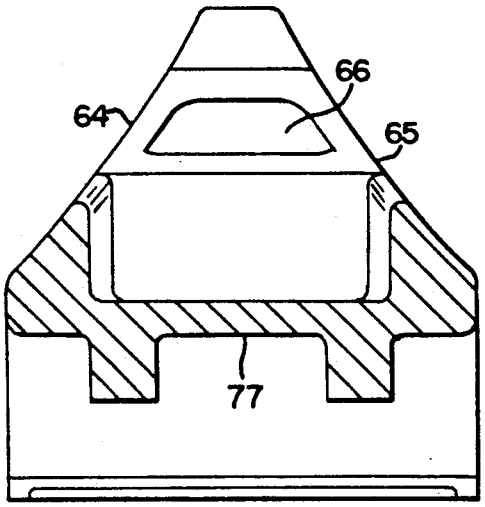
FIG. 11 is a vertical sectional view taken substantially along line 11—11 of FIG. 3.
Figure 12:
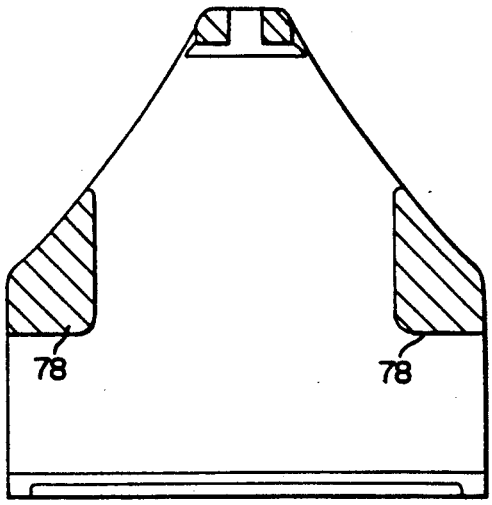
FIG. 12 is a vertical sectional view taken substantially along line 12—12 of FIG. 3.
Figure 13:
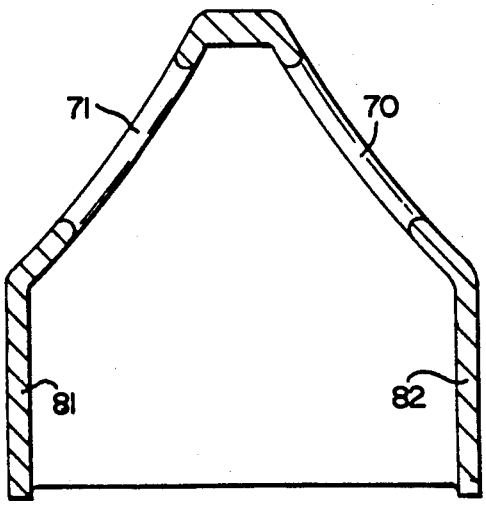
FIG. 13 is a vertical sectional view taken substantially along line 13—13 of FIG. 3.
Figure 14:
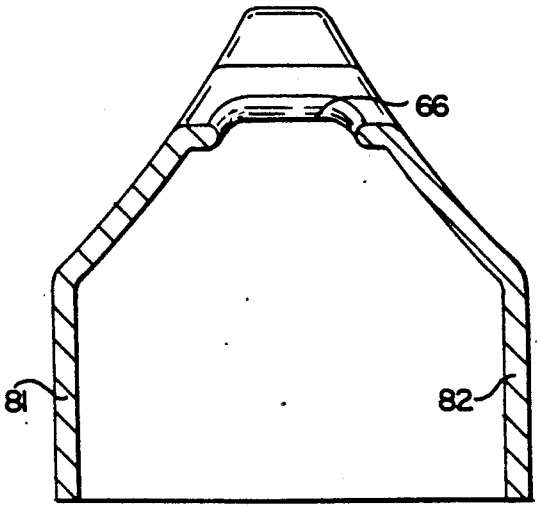
FIG. 14 is a vertical sectional view taken substantially along line 14—14 of FIG. 3.

The handle 98 in this embodiment is substantially different from the handle in the embodiment of FIGS. 9 and 10 in that it is more heavily constructed and further constructed so that it can cooperate with and coact with a hook-shaped slot 100 formed in the upper wall 60 of the main chock body. As seen particularly in FIGS. 16 and 17, the slot 100 includes a main slot portion **100*a* and a notched slot portion 100*b*** at the end of the slot closest to the very latch end of the main chock body.

The handle 98 of the latch includes a triangularly shaped portion 102 that is in opposed relation to the vertical fastening flange 97 but in offset relation therefrom, as particularly seen in FIGS. 19 and 20 for a reason that will be apparent below. At the upper apex of the triangularly shaped portion 102, the handle is in the form of a relatively thin stem 103 terminating in a ring 104. The stem has a narrow width, as seen in FIG. 19, which allows it to easily move along the main portion of the slot 100, and a depth as seen in FIG. 18 which is sized to fit in the locking notch 100*b*. Extending downwardly from the triangularly shaped portion 102 is a locking lug 105 which, as shown in FIG. 15, will lock over the rail 25 when in locked position. To provide more strength to the triangularly shaped portion 102 of the handle and the locking lug 105, a reinforcing rib 106 extends vertically from the top of the portion 102 to the bottom of the lug 105, as particularly seen in FIGS. 18 and 19.

When the latch is properly mounted on the vertical wall 48, it is bolted to the wall by means of three nut and bolt assemblies 108 which securely fasten the latch to the main chock body and produce a highly reliable fastening arrangement.

Figure 17:
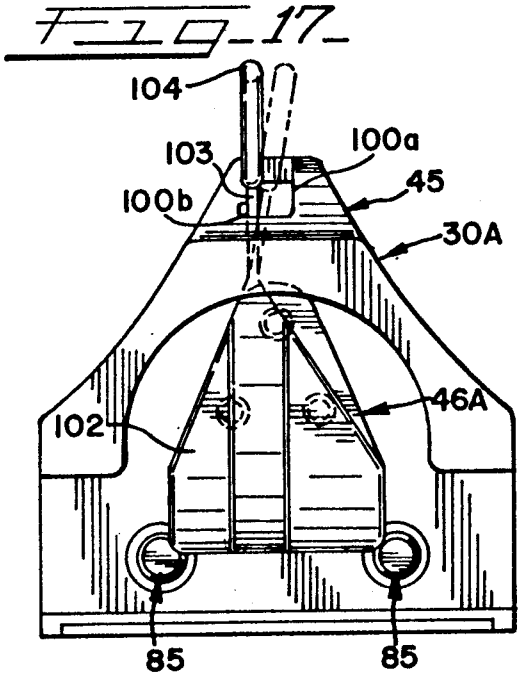
FIG. 17 is an end elevation of the latch end of the chock illustrating the latch in locked position in solid and in unlocked position in dotted.

In operation the latch may be moved to unlatched position by grasping the ring 104, laterally displacing the stem 103 from the locking notch 100*b*, and then driving the handle toward the boss/catch end of the chock in order to raise the locking lug 105 sufficiently so that it does not engage the outside wall of the outer rail and then the chock can be shifted transverse the other rail away from the adjacent outside wall of the container to disengage both the pins 85 and the boss/-catches at the boss/catch end of the chock. The depth of the stem 103 is such that it will withstand the forces of moving the handle to unlocking position with minimal flexing in the direction of movement, while the width is thin in order to allow it to laterally flex when moving the handle laterally to disengage the handle from the locking notch of the slot. When the handle is allowed to come back to the locking or latch position, it will do so by virtue of the memory in the plastic and the web 97 wanting to straighten to the position shown in FIG. 18. When the handle reaches the locking notch 100*b*, it automatically is biased into the notch as shown in FIG. 17 to maintain the latch in locked position. Thus, this latch differs from the latch of FIGS. 9 and 10 in that it coacts with a locking slot in the chock body in order to lock the handle in a position where the locking lug is latched over the outer rail, and this arrangement will provide more reliability in maintaining the latch end of the chock in locked position on the rail.

It will be understood that modifications and variations may be effected without departing from the scope of the novel concepts of the present invention, but it is understood that this application is to be limited only by the scope of the appended claims.

We claim:

1. A wheel chock for an intermodal container for motor vehicles adapted to be removably connected to and supported on first and second parallel spaced inverted U-shaped chock-rails fastened to the floor of the container, said chock adapted to be generally engaged by a vehicle wheel, each of said rails including a top surface on which the chock is supported, one of said rails including a plurality of spaced notched openings each of which defines a lip, the other of said rails including a plurality of spaced holes, said chock having a main body molded of a flexible material, chock-rail interfaces at opposite ends adapted to be in contact engagement, at least one boss/catch on one end of the body formed to be engageable in a notched opening to prevent movement longitudinally of the rail and under the lip to prevent movement upwardly of the rail, said boss/catch being engageable with the rail by insertion in a notched opening and by movement transverse the rail to engage the lip, at least one pin mounted at the other end of the body engageable in a hole of the other rail against movement longitudinally or upwardly of the rail, and a latch at said other end of the chock for selectively latching the chock to the rail against movement transverse the rails, said chock and rails coacting to support the chock above the container floor.

2. The wheel chock of claim 1, wherein the body includes a plurality of bosses at said one end.

3. The wheel chock of claim 1, wherein said pin is metal.

4. The wheel chock of claim 1, wherein a plurality of pins is mounted at said other end.

5. The wheel chock of claim 1, wherein said latch is of resilient and flexible material.

6. The wheel chock of claim 1, wherein said latch is separately molded of resilient and flexible material and mounted on said body.

7. The wheel chock of claim 1, wherein said chock is moved transversely of said rails to engage and disengage the notched openings and holes of the rails.

8. The wheel chock of claim 1, wherein said body includes vertical side walls at the lower part of the body causing the body to be relatively stiff vertically to prevent contact between the chock and floor and allowing the body to be relatively flexible longitudinally to absorb longitudinal loads.

9. The wheel chock of claim 6, wherein the latch includes a portion to coact with the rail and inhibit movement of the chock transversely.

10. The wheel chock of claim 1, wherein the body includes sloping walls intermediate the ends.

11. The wheel chock of claim 10, wherein an opening is provided in the body between said sloping sides to enhance the flexibility of the sloping sides to absorb longitudinal loads.

12. The wheel chock of claim 1, wherein said body includes integrally molded reinforcing walls.

13. The wheel chock of claim 1, wherein said chock-rail interfaces are constructed to distribute all vertical loads exerted by a vehicle wheel over the areas in contact with the rails.

14. The wheel chock of claim 13, wherein said chock-rail interfaces are further constructed to provide a partial longitudinal reaction by creating a significant static frictional force developed by a vertical load on the chock.

15. A wheel chock for an intermodal container for motor vehicles adapted to be removably connected to and supported on first and second parallel spaced inverted U-shaped chock-rails fastened to the floor of the container, said chock adapted to be generally engaged by a vehicle wheel, each of said rails including a top wall extending generally horizontally and downwardly extending spaced and generally vertically extending side walls, said rails extending longitudinally of the container and being at one side of the container and between which the automobile wheel is received, said first rail being the inside rail and including a plurality of equally spaced notched openings along a part of the top wall and part of a side wall to define a lip at the top wall, said second rail being the outside rail and including a plurality of spaced holes in the vertically extending side wall closest to the inside rail, said chock having a main body molded of a flexible copolymer material, chock-rail interfaces at the opposite ends adapted to be in contact engagement with the rails, a plurality of boss/-catches integrally molded with the body at one end and formed to be engageable in said notched openings against movement longitudinally of the rail, each boss/-catch including a projection adapted to underlie said lip and prevent movement upwardly of the rail, said boss/-catch being engageable with the rail by insertion in a notched opening and by movement transverse the rail to engage the lip, a plurality of pins mounted at the other end of the chock body engageable in said holes of the outside rail to prevent movement longitudinally and upwardly of the rail, said chock and rails coacting to support the chock above the container floor, and latching means at the end of the chock body where the pins are mounted for selectively latching the chock against movement transverse the rails.

16. The wheel chock of claim 15, wherein said pins are metal.

17. The wheel chock of claim 15, wherein said latch is separately molded of flexible copolymer material and mounted on the body.

18. The wheel chock of claim 15, wherein said chock is movable transversely of said rails to engage and disengage the notched openings and holes of the rails.

19. The wheel chock of claim 15, wherein said body includes vertical side walls at the lower part of the body causing the body to be relatively stiff vertically to prevent contact between the chock and floor and relatively flexible longitudinally to absorb longitudinal loads.

20. The wheel chock of claim 15, wherein the body includes opposite upper sloping sides intermediate the ends for engaging the wheels.

21. The wheel chock of claim 15, wherein said chock-rail interfaces are constructed to distribute all vertical loads exerted by a vehicle wheel over the areas in contact with the rails.

22. The wheel chock of claim 15, wherein said chock-rail interfaces are further constructed to provide a partial longitudinal reaction by creating a significant static frictional force developed by a vertical load on the chock.

23. The wheel chock of claim 15, wherein the latch includes a generally horizontal portion to generally contact the top wall of the rail and a generally vertical portion to overly the side wall of the rail opposite the side wall having the pin holes.

24. The wheel chock of claim 15, wherein the container is box-shaped and adaptable to be received on a railroad car, a wheeled truck, or a sea-going vessel.

25. The wheel chock of claim 15, wherein said chock body includes means coacting with the latch to lock the latch in latched position.

26. The wheel chock of claim 15, wherein the latch includes a handle and said main body includes a slot through which the handle extends, and said slot having a locking notch for receiving the handle to lock the handle and latch in a latching position.

* * * * *